US005546604A

United States Patent [19]

Geller

[11] Patent Number: 5,546,604

[45] Date of Patent: Aug. 20, 1996

[54] HOOD WITH A CONCEALING FACE MASK

[75] Inventor: Alan Geller, Carle Place, N.Y.

[73] Assignee: Fun World, Carle Place, N.Y.

[21] Appl. No.: 386,072

[22] Filed: Feb. 9, 1995

[51] Int. Cl.[6] ..... A42B 1/06

[52] U.S. Cl. ..... 2/202; 2/9; 2/173; 2/195.7; 2/195.8; 2/206; 2/424

[58] Field of Search ..... 2/9, 4, 172, 173, 2/195.7, 195.8, 202, 203, 204, 205, 206, 410, 424

[56] References Cited

U.S. PATENT DOCUMENTS

| | | | |
|---|---|---|---|
| 1,097,530 | 5/1914 | Cabelinsky | 2/202 |
| 3,561,010 | 2/1971 | Little | 2/173 |
| 4,941,211 | 7/1990 | Blutstein | 2/202 |
| 5,109,548 | 5/1992 | Balaban et al. | 2/202 |
| 5,142,704 | 9/1992 | Viemeister et al. | 2/202 |
| 5,249,307 | 10/1993 | Lemoine | 2/4 |

*Primary Examiner*—Diana Biefeld
*Attorney, Agent, or Firm*—Collard & Roe, P.C.

[57] ABSTRACT

A garment for covering a wearer's head and face including a hood worn over the head with a tailpiece adjacent a rear portion of the head. The hood is made from a non-shrink material. A mesh face mask is attached to the hood to cover and conceal the face while allowing the wearer to see out through the face mask. A cowl is formed along a portion of the junction between the hood and the face mask and extends out over the face mask. The cowl may be formed from a single piece of material or two differently colored pieces of material. A central padded layer may be inserted within the cowl to give it additional thickness and shape.

13 Claims, 2 Drawing Sheets

HOOD WITH A CONCEALING FACE MASK

BACKGROUND OF THE INVENTION

1. Field of the Invention

The invention relates to a hood with a concealing face mask. More particularly, it relates to a hood with a face mask that covers and conceals the face while allowing the wearer to see out through the face mask.

2. The Prior Art

Face masks according to the prior art typically cover the wearer's face and are attached by an elastic band passing around the head. Other more extensive masks cover the entire face and head. Typically, the face mask is constructed from an opaque material with decorative feature provided on the external surface thereof. Eye slits are formed in the mask in order to permit the wearer to see while wearing the mask. These eye slits have a tendency to detract from the overall appearance of the mask as they reveal a characterizing feature of the wearer which may give away the wearer's identity. Accordingly, it would be desirable to provide a hood and face mask that completely covers the wearer's head and face while still allowing the wearer to see through the face mask.

SUMMARY OF THE INVENTION

It is, therefore, an object of the present invention to overcome the drawbacks of the prior art and to provide a hood with a concealing face mask that completely covers the wearer's head and face.

It is a further object of the present invention to provide the wearer with the ability to see through the concealing face mask.

These and other related objects are achieved according to the invention with a device for covering a wearer's head and face consisting of a hood adapted to be worn over the head with a tailpiece proximate a rear portion of the head. The hood is made from a non-shrink material. A mesh face mask is attached to the hood and adapted to cover and conceal the face while allowing the wearer to see therethrough. A cowl is formed along a portion of the junction between the hood and the face mask and extends over the face mask. The tailpiece extends outwardly from the hood in a first direction and the cowl extends outwardly from the hood in the second direction, generally opposite the first direction. The hood optionally includes an elongated lower section extending approximately to the wearer's shoulder with a frayed edge.

The junction between the hood and the face mask includes an upper portion, side portions, and a lower portion. The cowl is formed along the upper portion and the side portions only. The cowl is formed by a folded over section of the hood. The non-shrink material is a woven, polyester material. Connection means are provided at the lower portion for removably attaching the face mask to the hood, whereby the face mask is detached from the hood to permit the wearer to eat and drink. The connection means comprises a hook and loop fastener.

The cowl alternatively includes an outer layer formed by a section of the hood and a separate inner layer made from the material having a different color than the hood. The cowl further includes a central padded layer disposed between the inner and outer layers. The central padded layer provides added thickness and shape to the cowl. A cape is optionally attached to a rear portion of the hood and is adapted to extend down along the wearer's back.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
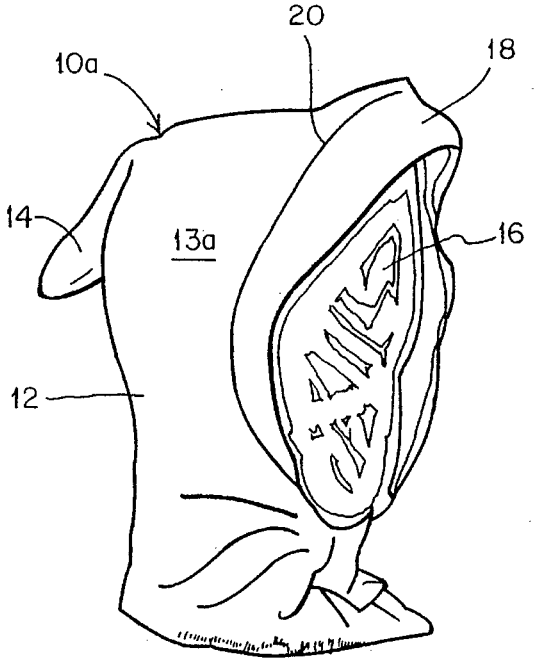
FIG. 1 is a front, top, left-side perspective view of a hood with a concealing face mask according to the invention.
Figure 2:
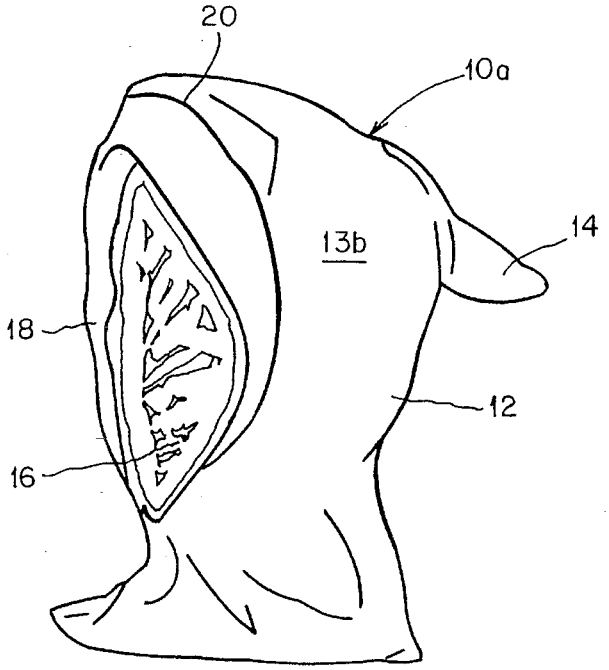
FIG. 2 is a front, top, right-side perspective view thereof.

Referring now in detail to the drawings, and in particular FIGS. 1 and 2, there is shown a garment 10*a* according to the invention consisting of a hood 12 having an integrally formed tailpiece 14. Hood 12 consists of a left hood panel 13*a* and a right hood panel 13*b*. Each hood panel 13*a* and 13*b* has a pointed tip along a rear extent thereof. Tailpiece 14 has a generally conical shape. In use, tailpiece 14 folds downwardly proximate a rear portion of the wearer's head providing an attractive and decorative feature to the garment.

Hood 12 covers the entire head and neck of the wearer and includes an oval opening generally corresponding to the wearer's face. A face mask 16 is attached to the hood to completely fill the opening to cover and conceal the wearer's face. The face mask is made from a woven mesh material which totally conceals the wearer's face to prevent identification of the wearer. However, since the face mask is disposed fairly close to the wearer's eyes, it is possible to see clearly through the mask. The face mask appears almost completely opaque for an outside viewer while appearing substantially translucent for the wearer.

The junction where the face mask is attached to the hood includes a top portion, two side portions, and a lower portion. A cowl 18 is formed along the top and side of this junction. Cowl 18 extends forwardly of face mask 16. Face mask 16 is recessed within hood 12 by virtue of forwardly extending cowl 18. Cowl 18 is not present along the lower portion of face mask 16. Along the lower portion, face mask 16 flows smoothly into hood 12. By recessing face mask 16, the top and sides of the junction are further concealed adding to the overall hooded effect provided by garment 10*a*.

Hood 12 is made from a non-shrink jersey or woven material, for example, preferably polyester or other suitable fabrics. Face mask 16 is preferably made from a dark or black mesh or woven material that is semi-transparent or sheer material such as used on a woman's stocking, for example, sheer nylon or LYCRA brand elastic material. The LYCRA brand elastic material or nylon material is typically a 4–15 g./denier material that includes closely spaced horizontal ribbing in face mask 16. The LYCRA brand elastic material or nylon material can also be a knitted material as well.

Tailpiece 14 extends outwardly from the hood in a rearward direction. Cowl 18 extends outwardly from hood 12 in an opposite forward direction. Cowl 18 is formed by a folded over section of hood 12. More specifically, hood panels 13*a* and 13*b* extend forwardly beyond face mask 16 and are then folded back. A line of stitching 20 extends through the outer layer of hood panels 13*a* and 13*b*, the folded over layer of the hood panel and face mask 16. Cowl 18 is thus formed in front of stitching 20 by a folded over section of hood 12. Along the bottom section of face mask 16, face mask 16 is stitched directly to hood panels 13*a* and 13*b* without the foldover, cowl-forming section.

Figure 3:
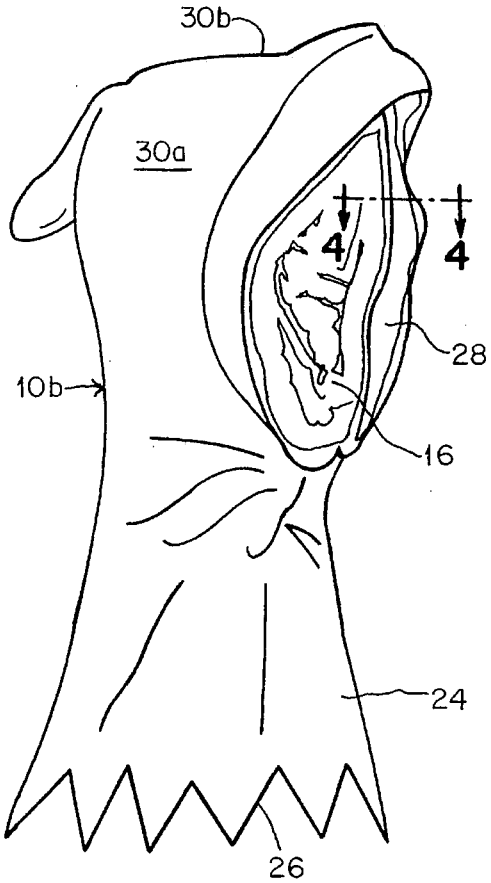
FIG. 3 is a front, top, left-side perspective view of an alternate embodiment of the hood which includes an elongated lower section.
Figure 4:
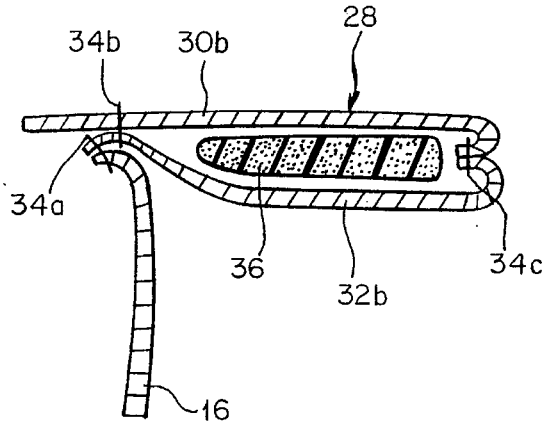
FIG. 4 is a cross-sectional view taken along the line 4—4 from FIG. 3.

Referring now to FIG. 3, there is shown an alternate embodiment of garment 10*b* with an elongated lower section 24. At a lower periphery thereof, there is provided a frayed or saw-tooth edge 26. While garment 10*a* extends down to cover the wearer's neck, elongated lower section 24 extends even lower to drape over the wearer's shoulders, upper chest and upper back. Elongated lower section 24 may be tucked into another garment, or worn exteriorly of another garment to add to the overall aesthetics of the costume. Garment 10*b* has a modified cowl 28 which is shown in cross section in FIG. 4. As with garment 10*a*, garment 10*b* includes hood panels 30*a* and 30*b*. As can be seen in FIG. 4, hood panel 30*b* only forms the outer surface of cowl 28. A separate cowl panel 32*b* is attached thereto to form the inner surface of cowl 28. Cowl panel 32*b* is attached between face mask 16 and hood panel 30*b* by stitching 34*a*, 34*b*, and 34*c*. A padded layer 36 may be disposed between hood panel 30*b* and cowl panel 32*b*. In addition, padded layer 36 may be attached to the panels at stitching 34*c* or an additional row of stitching adjacent stitching 34*c*. Padded layer 36 may also be attached to the panel at stitching 34*b*. By attaching the padded layer to the panels, padded layer 36 remains in place and is prevented from bunching up or sliding out of position.

In place of stitching 34*a* and 34*b*, a single line of stitching may pass through the edge of face mask 16, the edge of cowl panel 32*b*, the edge of padded layer 36, and through hood panel 30*b*. The edge of face mask 16, the edge of cowl panel 32*b*, the edge of padded layer 36, and hood panel 30*b* may also be connected together with a combination of one or more lines of stitching, as will be well known to those skilled in the art. Padded layer 36 is foam rubber, for example, which provides added thickness and shape to cowl 28. In a slightly modified construction, stitching 34*c* may be eliminated and hood panel 30*b* could extend continuously around padded layer 36, in place of cowl panel 32*b*. The advantage of using a separate cowl panel 32*b* is a differently colored material may be used compared to hood panels 30*a* and 30*b*. For example, hood panels 30*a* and 30*b* could be red or purple. Face mask 16 could be made from a black mesh with cowl panels 32*b* made from a black non-shrink material. By making the cowl panel the same color as the face mask, the features behind the face mask are further obscured. As is somewhat shown in FIG. 4, all of the stitching is done from the inside of the mask so that none of it is visible when the garment is worn. For example, an overlock stitch or other suitable stitches may be used to join the various panels together, as will be readily apparent to those skilled in the art.

Figure 5A:
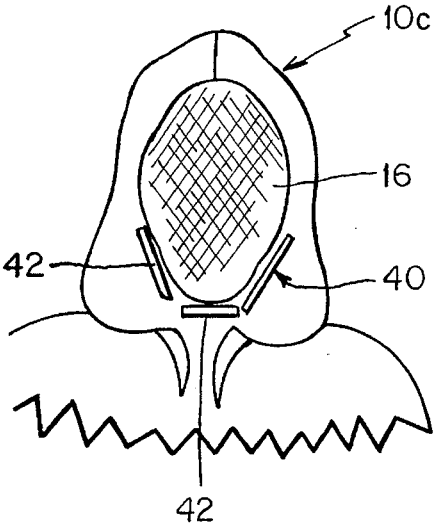
FIG. 5A is a front, side-elevational view of a further embodiment of the hood including a partially detachable face mask.
Figure 5B:
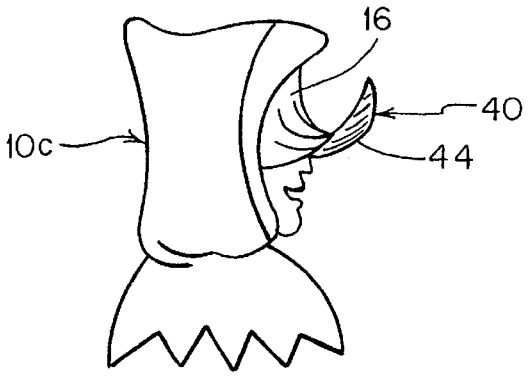
FIG. 5B is a right, side-elevational view thereof.

FIGS. 5A and 5B show a further garment 10*c* with a face mask 16 which is detachable along the lower half thereof. Connection means 40 is provided to removably attach face mask 16 to the corresponding region on garment 10*c*. Connection means 40 consists of a hook portion 42 and a loop portion 44. The hook and loop portions are located along the bottom half of face mask 16 and the corresponding regions on garment 10*c*. When face mask 16 is lowered and connected, its appearance is indistinguishable from the mask shown in FIGS. 1 and 2. When the lower half of mask 16 is detached and lifted, as shown in FIG. 5B, the wearer can eat or drink before closing face mask 16.

Figure 6:
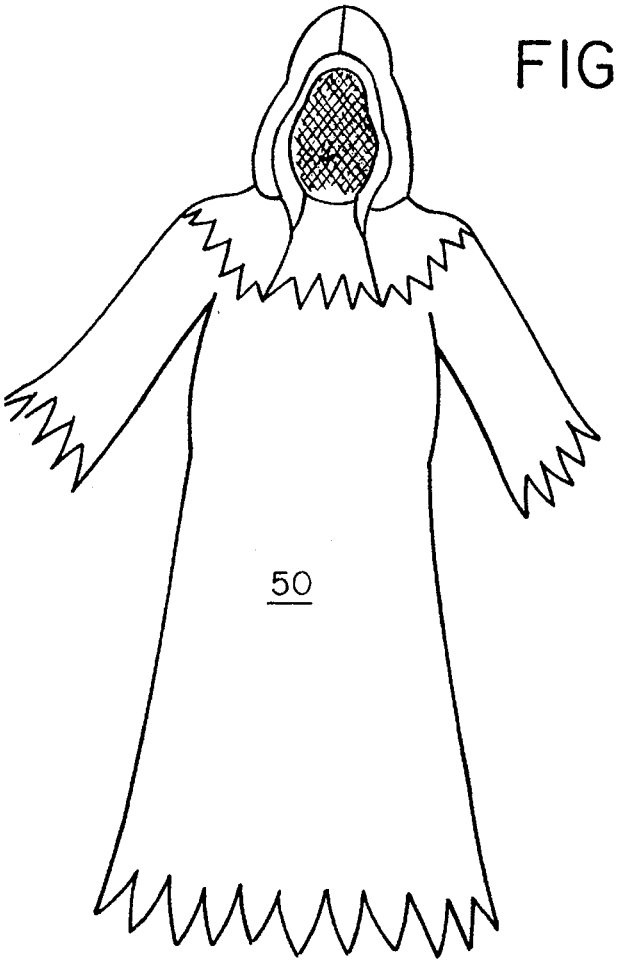
FIG. 6 is a front, side-elevational view of another embodiment of the hood, including a cape.

As can be seen in FIG. 6, a cape 50 may be attached to garment 10*a*, 10*b* or 10*c*. Cape 50 can be attached to the hood shown in FIGS. 1 and 2, or it may be attached to elongated lower section 24, shown in FIG. 3.

While several embodiments of the present invention have been shown and described, it is to be understood that many changes and modifications may be made thereunto without departing from the spirit and scope of the invention as defined in the appended claims.

What is claimed is:

1. A device for covering a wearer's head, face and eyes comprising:

a hood adapted to be worn over a head, said hood being made from a non-shrink material;

a dark mesh face mask made from a woven material attached to said hood and adapted to completely cover a face with an inner side proximate a face and an opposite outer side, said face mask appearing semi-transparent from the inner side enabling a wearer to see clearly through the mask while appearing opaque from the outer side to totally conceal a wearer's face and eyes; and a cowl formed along a portion of the junction between said hood and said face mask, said cowl extending forwardly over said face mask so that said face mask is recessed within said hood to further conceal a face.

2. The device according to claim 1, comprising a tailpiece extending outwardly from said hood in a first direction with said cowl extending in a second direction, generally opposite said first direction.

3. The device according to claim 2, wherein said hood includes an elongated lower section with a frayed edge.

4. The device according to claim 2, comprising a cape attached to a rear portion of said hood adapted to extend down along the wearer's back.

5. A device for covering a wearer's head and face comprising:

a hood adapted to be worn over a head with a tailpiece proximate a rear portion of a head, said hood being made from a non-shrink material;

a semi-transparent face mask attached to said hood and adapted to cover and conceal a face while allowing a wearer to see therethrough; and a cowl formed along a portion of the junction between said hood and said face mask, said tail piece extending outwardly from said hood in a first direction and said cowl extending outwardly from said hood in a second direction generally opposite said first direction, wherein said cowl extends forwardly over said face mask so that said face mask is recessed within said hood to further conceal a face.

6. The device according to claim 5, wherein the junction between said hood and said face mask includes an upper portion, side portions and a lower portion, said cowl is formed along said upper portion and said side portions only.

7. The device according to claim 6, comprising connection means at said lower portion for removably attaching said face mask to said hood, whereby said face mask is partially detached from said hood to permit the wearer to eat and drink.

8. The device according to claim 7, wherein said connection means comprises a hook and loop fastener.

9. The device according to claim 6, wherein said cowl includes an outer layer formed by a section of said hood and a separate inner layer made from a material having a different color than said hood.

10. The device according to claim 9, wherein said cowl further includes a central padded layer disposed between said inner and outer layers, said central padded layer provides added thickness and shape to said cowl.

11. The device according to claim 5, wherein said cowl is formed by a folded over section of said hood.

12. The device according to claim 5, wherein said non-shrink material is a woven, polyester material.

13. The device according to claim 5, wherein said non-shrink material is a knitted, polyester material.

* * * * *